US007356994B2

(12) United States Patent
Bleeker

(10) Patent No.: US 7,356,994 B2
(45) Date of Patent: Apr. 15, 2008

(54) ALIGNMENT AND POSITIONING SYSTEM FOR INSTALLING A FUEL INJECTOR IN A GAS TURBINE ENGINE

(75) Inventor: Daniel E. Bleeker, Ankeny, IA (US)

(73) Assignee: Delavan Inc, West Des Moines, IA (US)

( * ) Notice: Subject to any disclaimer, the term of this patent is extended or adjusted under 35 U.S.C. 154(b) by 442 days.

(21) Appl. No.: 11/087,046

(22) Filed: Mar. 22, 2005

(65) Prior Publication Data

US 2005/0223709 A1 Oct. 13, 2005

Related U.S. Application Data

(60) Provisional application No. 60/561,116, filed on Apr. 9, 2004.

(51) Int. Cl.
*F02C 7/22* (2006.01)

(52) U.S. Cl. ..... 60/798; 60/740

(58) Field of Classification Search ..... 60/796, 60/798, 800, 740

See application file for complete search history.

(56) References Cited

U.S. PATENT DOCUMENTS 2,422,214 A 6/1947 Meyer et al.
3,398,529 A * 8/1968 Schmitz et al. ..... 60/796
3,458,997 A 8/1969 Clark
3,879,940 A 4/1975 Stenger et al.
6,354,085 B1 * 3/2002 Howell et al. ..... 60/740

FOREIGN PATENT DOCUMENTS

EP 0 837 284 A2 4/1998
EP 1 286 111 A2 2/2003

OTHER PUBLICATIONS

EPO Search Report dated Mar. 30, 2006.

* cited by examiner

*Primary Examiner*—Ted Kim
(74) *Attorney, Agent, or Firm*—Scott D. Wofsy; Edwards Angell Palmer & Dodge LLP

(57) ABSTRACT

A fuel injector for a gas turbine engine is disclosed wherein the engine has an engine case that includes a reception bore for accommodating the fuel injector, and wherein the fuel injector includes a fuel inlet fitting having an annular mounting flange defining opposed upper and lower end surfaces and a cylindrical body portion which depends axially from the lower end surface of the mounting flange, the inlet fitting having integrally formed alignment structure located beneath the lower end surface of the mounting flange for guiding the fuel injector into an installed position within the reception bore of the engine case.

22 Claims, 5 Drawing Sheets

ALIGNMENT AND POSITIONING SYSTEM FOR INSTALLING A FUEL INJECTOR IN A GAS TURBINE ENGINE

CROSS-REFERENCE TO RELATED APPLICATION

The subject application claims the benefit of priority from U.S. Provisional Patent Application Ser. No. 60/561,116, which was filed on Apr. 9, 2004, the disclosure of which is herein incorporated by reference in its entirety.

BACKGROUND OF THE INVENTION

1. Field of the Invention

The subject invention is directed to fuel injectors for gas turbine engines, and more particularly, to an alignment and positioning system for installing a fuel injector in a reception bore formed in the engine case of a gas turbine engine.

2. Background of the Related Art

The inlet end fittings of prior art fuel injectors used in gas turbine engines have employed alignment pins to guide the installation of the fuel injector into a reception bore formed in the engine case, and to subsequently maintain the fuel injector in a desired position within the engine case once it has been installed. Typically, such alignment pins have been permanently secured within the mounting flange of the fuel injector. For example, two stainless steel conical alignment pins are currently brazed into corresponding apertures formed in the mounting flange of the fuel injectors used in the GE T700 turbo shaft engine, which went into service in the 1970's. These brazed alignment pins have been employed for decades by injector manufacturers to facilitate the guided installation and proper positioning of fuel injectors in an engine case of a gas turbine engine.

Those skilled in the art will readily appreciate however, that the current alignment pin design is costly and inconvenient, in that it requires the procurement, inspection, installation and brazing of multiple components.

It would be beneficial therefore, to provide a less expensive and more convenient system for ensuring the proper alignment and positioning of a fuel injector in the engine case of a gas turbine engine.

SUMMARY OF THE INVENTION

The subject invention is directed to a nozzle alignment and positioning system for installing and subsequently securing a fuel injector in a reception bore formed in the engine case of a gas turbine engine. More particularly, the subject invention is directed to a fuel injector for a gas turbine engine that includes a fuel inlet fitting having an annular mounting flange defining opposed upper and lower end surfaces and a generally cylindrical body portion which depends axially from the lower end surface of the mounting flange. In accordance with a preferred embodiment of the subject invention, integrally formed alignment means are located beneath the lower end surface of the mounting flange for guiding the fuel injector into an installed position within a reception bore of the engine case. The integrally formed alignment means eliminates the need for furnace brazing separate alignment pins into corresponding apertures formed in the mounting flange of the fuel injector, as known and practiced in the prior art for many years.

More particularly, the fuel inlet fitting of the subject invention is provided with a pair of integrally formed alignment structures that depend from the lower end surface of the mounting flange and extend radially outwardly from the generally cylindrical body portion of the fuel inlet fitting. In accordance with the subject invention, the alignment structures are adapted and configured to guide the fuel injector into an installed position within the reception bore of the engine case. These alignment structures are positioned to align with corresponding reception notches defined within each reception bore of the engine case. Once engaged, the integrally formed alignment structures serve to maintain the fuel injector in its correctly seated position within the reception bore of the engine case.

The integrally formed alignment structures are diametrically opposed to one another relative to the central axis of the generally cylindrical body portion of the fuel inlet fitting, and they are dissimilar in axial height relative to the generally cylindrical body portion, which includes an upper cylindrical section and a lower inwardly tapered section. The integrally formed alignment structures include a leading alignment structure and a trailing alignment structure. The leading alignment structure has an axial height that is typically but not necessarily greater than the axial height of the trailing alignment structure, relative to the axial height of the generally cylindrical body portion of the fuel inlet fitting.

In one embodiment of the subject invention, the leading alignment structure has an axial height that is substantially equal to the axial height of the entire cylindrical body portion, and the trailing alignment structure has an axial height that is substantially equal to the axial height of the upper cylindrical section of the cylindrical body portion. In another embodiment of the subject invention, the leading alignment structure has an axial height that is substantially equal to the axial height of the upper cylindrical section of the cylindrical body portion, and the trailing alignment structure has an axial height that is less than the axial height of the upper cylindrical section of the cylindrical body portion.

Preferably, the shorter trailing alignment structure has a generally rectangular configuration that includes a convex outer surface. The longer leading alignment structure has a polygonal configuration that includes a truncated convex outer surface. In accordance with the subject invention, the truncation of the convex outer surface defines an inwardly tapered camming facet for interacting with the reception bore of the engine case during installation of the fuel injector, to effectively guide the fuel injector into a properly seated position.

These and other aspects of the fuel injector alignment and positioning system and the fuel injector of the subject invention will become more readily apparent to those having ordinary skill in the art from the following detailed description of the invention taken in conjunction with the drawings.

BRIEF DESCRIPTION OF THE DRAWINGS

So that those having ordinary skill in the art to which the present invention pertains will more readily understand how to make and use the fuel injector alignment and positioning system of the present invention, embodiments thereof will be described in detail hereinbelow with reference to the drawings, wherein.

DETAILED DESCRIPTION OF THE PREFERRED EMBODIMENTS

Figure 1:
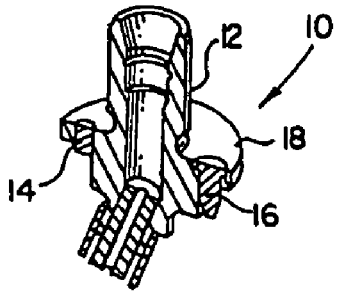
FIG. 1 PRIOR ART
FIG. 1 is a perspective view, in cross-section, of the inlet end portion of a prior art fuel injector, which employs two conical alignment pins secured within the mounting flange of the injector by furnace brazing to guide the installation of the fuel injector into a reception bore of the engine case.

Referring now to the drawings wherein like reference numerals identify similar features or structures of the subject invention, there is illustrated in FIG. 1 the fuel inlet portion of a prior art fuel injector designated generally by reference numeral 10. Prior art fuel injector 10 has a fuel inlet fitting 12 that employs a pair of stainless steel conical alignment pins 14 and 16 secured within the mounting flange 18 by furnace brazing or a similar joining technique. The alignment pins 14 and 16 guide the installation of the fuel injector 10 into a reception bore formed in the engine case of a gas turbine engine, and in addition, serve to maintain the fuel injector in its properly installed position within the engine case.

In connection with manufacturing the prior art fuel injector 10, it was necessary for the nozzle manufacturer to procure, inspect and inventory the alignments pins 14 and 16, for subsequent installation within the mounting flange 18 of the inlet fitting 12. This added unnecessarily to the manufacturing cost of the prior art fuel injector 10.

Figure 2:
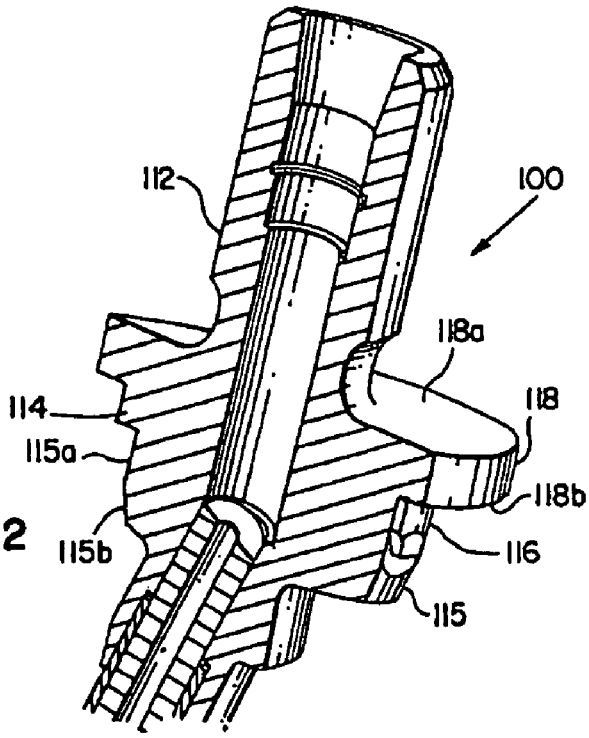
FIG. 2 is a perspective view, in cross-section, of the inlet end portion of a fuel injector constructed in accordance with a preferred embodiment of the subject invention, which employs integral alignment structures which guide the installation of the fuel injector into a reception bore of the engine case and maintain the injector in a properly seated position once installed.

Referring to FIG. 2, there is illustrated the fuel inlet portion of a fuel injector 100 constructed in accordance with a preferred embodiment of the subject invention. Fuel injector 100 provides an alignment and positioning system for installing and securing fuel injectors in the engine case of a gas turbine engine, which overcomes the disadvantages of the prior art alignment system discussed above.

Fuel injector 100 includes a one-piece fuel inlet fitting 112, which has an annular mounting flange 118 defining substantially planar upper and lower end surfaces 118*a* and 118*b*. Diametrically opposed, integral alignment structures 114 and 116 are formed beneath or otherwise depend from the lower end surface 118*b* of mounting flange 118. The integral alignment structures 114 and 116 are machined as part of the mounting flange and/or main body section 115 of the fuel inlet fitting 112, using numerically controlled machining technology. The integrally formed alignment structures 114 and 116 extend radially outwardly from the main body section 115 of fuel inlet fitting 112. The main body section 115 of fuel inlet fitting 112 includes an upper cylindrical portion 115*a* and a lower inwardly tapered portion 115*b*.

Figure 2A:
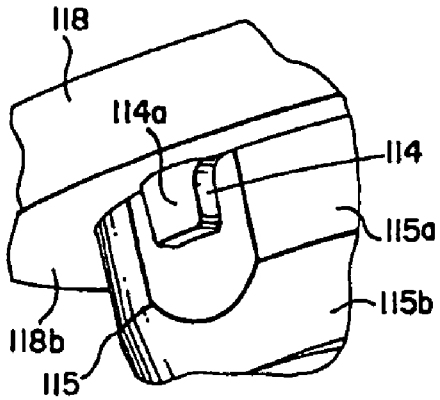
FIG. 2*a* is an enlarged localized perspective view of a first (trailing) alignment structure integrally formed beneath the mounting flange of the fuel inlet fitting of the fuel injector of FIG. 2.
Figure 2B:
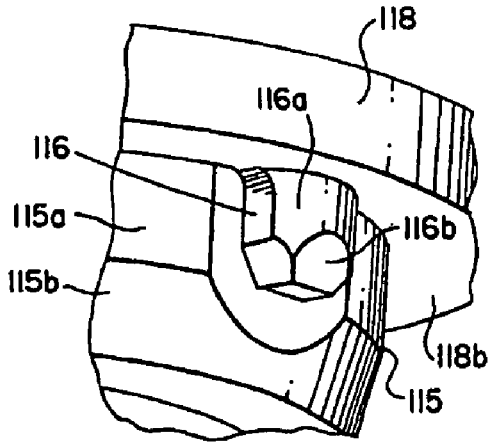
FIG. 2*b* is an enlarged localized perspective view of a second (leading) alignment structure integrally formed beneath the mounting flange of the fuel inlet fitting of the fuel injector of FIG. 2.

As best seen in FIG. 2*a*, alignment structure 114 has a generally rectangular shape with a convex outer surface 114*a*. Alignment structure 114 has an axial height that is less than the axial height of the upper cylindrical body section 115*a* of fuel inlet fitting 112. As shown in FIG. 2*b*, alignment structure 116 has a polygonal shape that includes a truncated convex outer surface 116*a*. Alignment structure 116 is longer than alignment structure 114 as it has an axial height that is about equal to the axial height of the upper cylindrical body section 115*a* of fuel inlet fitting 112. Those skilled in the art will readily appreciate that the dimensions, including the axial height, and/or the general shape of either or both of the integrally formed alignment structures 114 and 116 can vary depending upon the design and/or configuration of the particular fuel injector with which they are employed.

In accordance with the subject invention, alignment structure 116 is the leading alignment structure because it serves to lead or otherwise guide the fuel inlet fitting 112 of fuel injector 100 into an installed position within the reception bore of the engine case. Alignment structure 114 is the trailing alignment structure because it follows the leading alignment structure 116 into position within the reception bore of the engine case, as shown for example, in FIGS. 7*a* through 7*d*.

Figure 4:
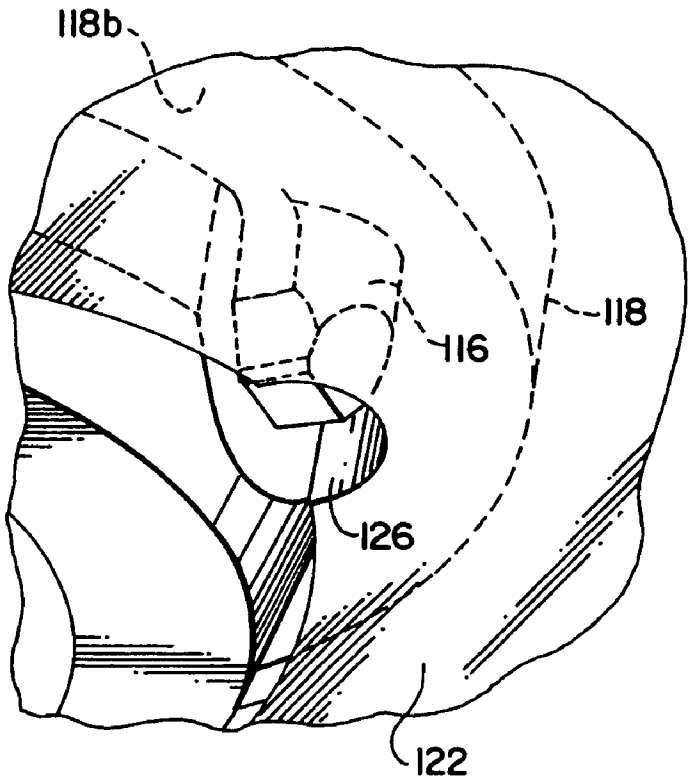
FIG. 4 is an enlarged localized perspective view, as seen from below, illustrating the engagement of the leading alignment structure formed beneath the mounting flange of the fuel inlet fitting of the fuel injector within a corresponding reception notch formed in the reception bore of the engine case.
Figure 3:
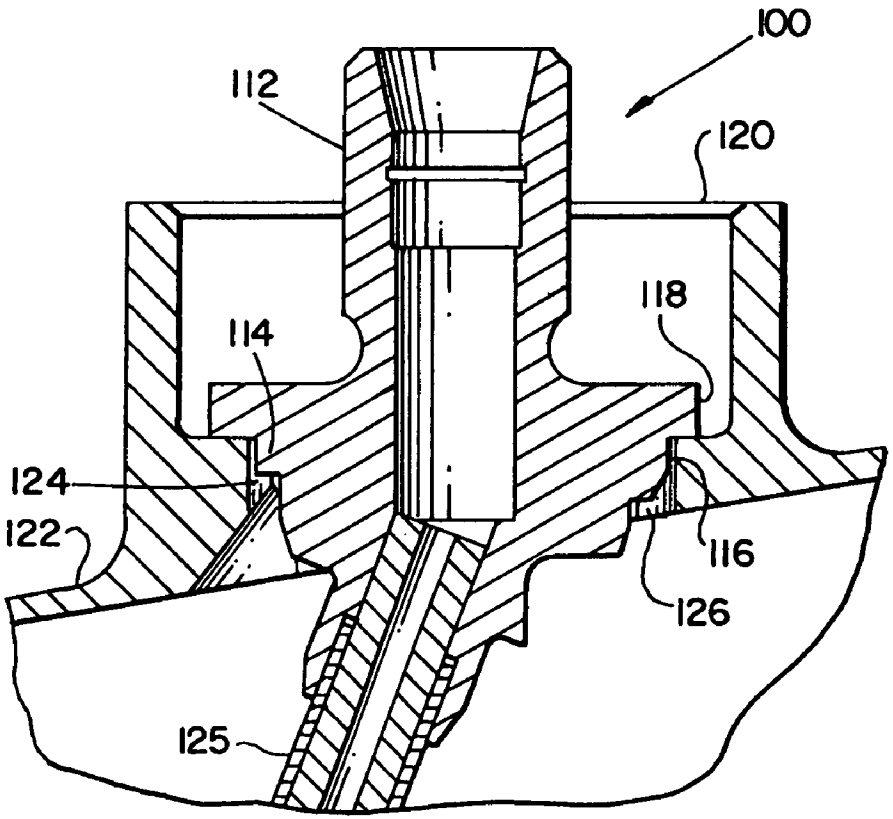
FIG. 3 is a cross sectional view of the reception bore of an engine case with the fuel injector of FIG. 2 installed therein such that the integrally formed alignment structures are seated within corresponding reception notches formed in the reception bore of the engine case.

Referring to FIG. 3, fuel injector 100 is illustrated in a properly seated position within the reception bore 120 of engine case 122. In this position, alignment structures 114 and 116 are engaged within corresponding diametrically opposed reception notches 124 and 126 formed in the wall of reception bore 120. For example, as shown in FIG. 4, alignment structure 116 is seated within corresponding reception notch 126. In this position, the two alignment structures 114 and 116 maintain the fuel injector 100 in its proper location within the engine case 122. Moreover, the alignment structures 114 and 116 function advantageously to prevent the fuel injector 100 from shifting or rotating while seated within the reception bore 120. This ensues that that the angled feed arm 125 is properly oriented within the engine case 122, as shown in FIG. 3.

During the installation of fuel injector 100 in engine case 122, the leading alignment structure 116 is mechanically guided into corresponding reception notch 126. At such a time, the truncated surface or inwardly tapered lower facet 116*b* of alignment structure 116 acts as a camming surface against the forward edge of reception notch 126. This mechanical interaction between the truncated camming facet 116*b* of the leading alignment structure 116 and the forward edge of reception notch 126 serves to facilitate the rotational or pivotal movement of the fuel inlet fitting 112 of fuel injector 100 into the installed position shown in FIG. 3.

Moreover, because the feed arm 125 of fuel injector 100 is oriented at an acute angle relative to the central axis of the fuel inlet fitting 112, it is necessary to introduce the fuel injector 100 into the engine case 122 at an angle and then subsequently rotate the inlet fitting 112 into a seated position in the reception bore 120.

While not shown in the accompanying drawings, the interior surface of reception bore 120 is threaded, and an externally threaded locking nut (also not shown) is used to secure the fuel inlet fitting 112 of injector 100 within bore 120 by applying an axially directed retaining force against the upper end surface 118*a* of mounting flange 118. In addition, a sealing ring or gasket may be interposed between the locking nut and the fuel inlet fitting to ensure the integrity of the fit.

Figure 6:
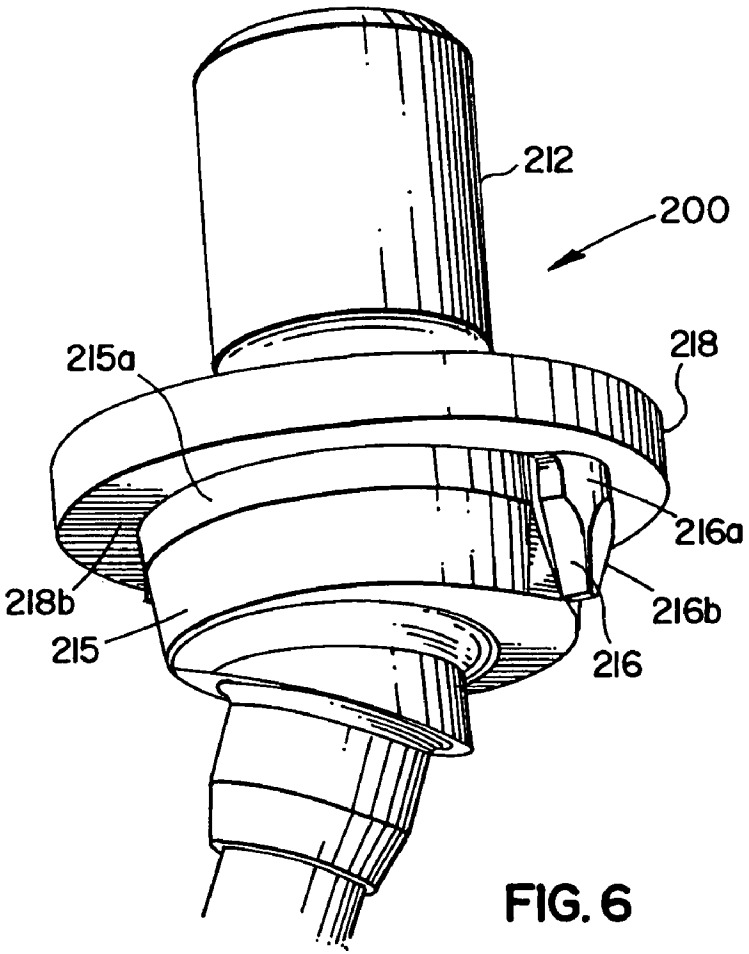
FIG. 6 is a perspective view of the inlet end portion of the fuel injector of FIG. 5, which employs an alternate configuration of the integrally formed alignment structures which facilitate the guided installation of the fuel injector into a reception bore of the engine case.
Figure 5:
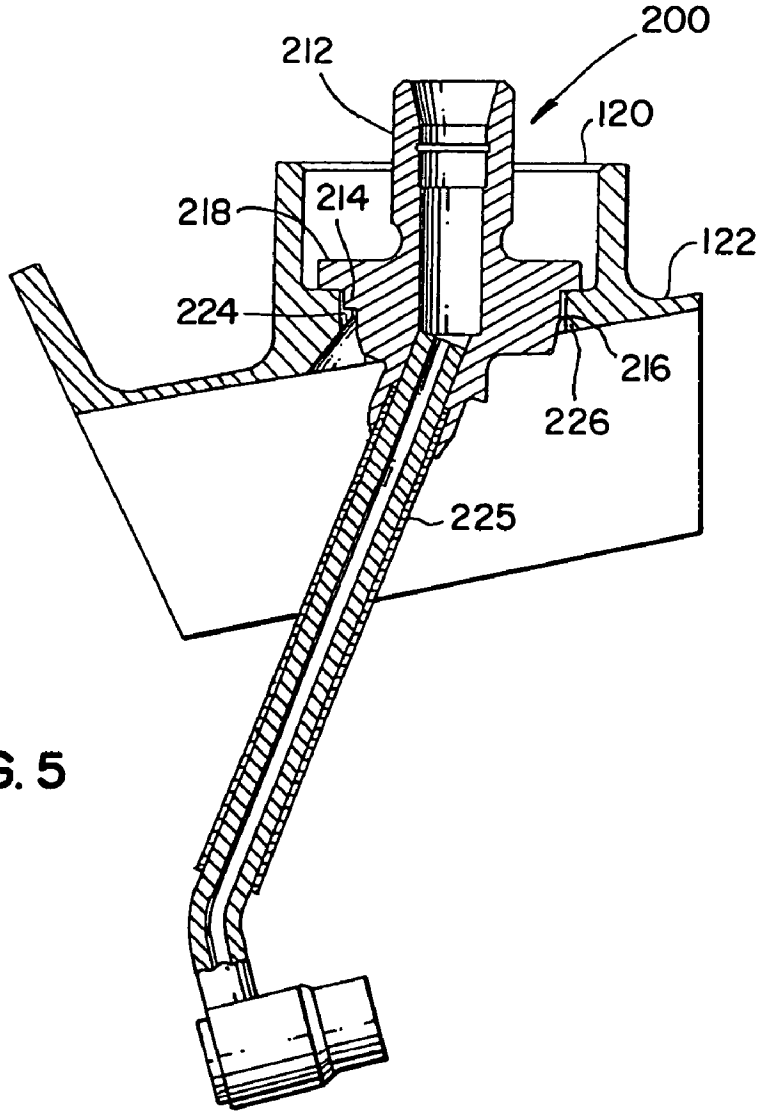
FIG. 5 is a side elevational view, in cross-section, of a fuel injector constructed in accordance with another preferred embodiment of the subject invention, installed within a reception bore of the engine case of a gas turbine engine.

Referring now to FIGS. 5 and 6, there is illustrated another fuel injector constructed in accordance with a preferred embodiment of the subject invention and designated generally by reference numeral 200. Fuel injector 200 is substantially identical to fuel injector 100 in that it includes a one-piece fuel inlet fitting 212, which has an annular mounting flange 218 with upper and lower end surfaces 118*a*, 118*b* and diametrically opposed, integrally formed alignment structures 214, 216 located beneath the lower end surface 218*b* of the mounting flange 218.

However, fuel injector 200 differs from fuel injector 100 in that the leading alignment structure 216 is relatively longer than the leading alignment structure 116 of fuel injector 100, as shown in FIG. 6. That is, the axial height of the leading alignment structure 216 is substantially equal to the axial height of the main body section 215 of fuel inlet fitting 212. In comparison, the axial height of the trailing alignment structure 214, which is configured in a manner similar to alignment structure 114, is about equal to the axial height of the upper cylindrical section 215*a* of main body section 215. Those skilled in the art will readily appreciate that the dimensions, including the axial height, and/or the general shape of either or both of the integrally formed alignment structures 214 and 216 can vary depending upon the design and/or configuration of the fuel injector with which they are employed.

The configuration of the leading alignment structure 216 is generally more effective during installation, as compared to alignment structure 116. This is because alignment structure 216 cooperatively guides the fuel injector 200 into the reception bore 120 of the engine case 122 for a greater distance, as shown in FIGS. 7*a* through 7*d*. This further ensures that the fuel inlet fitting 212 is properly seated in the reception bore 120.

Figure 7A:
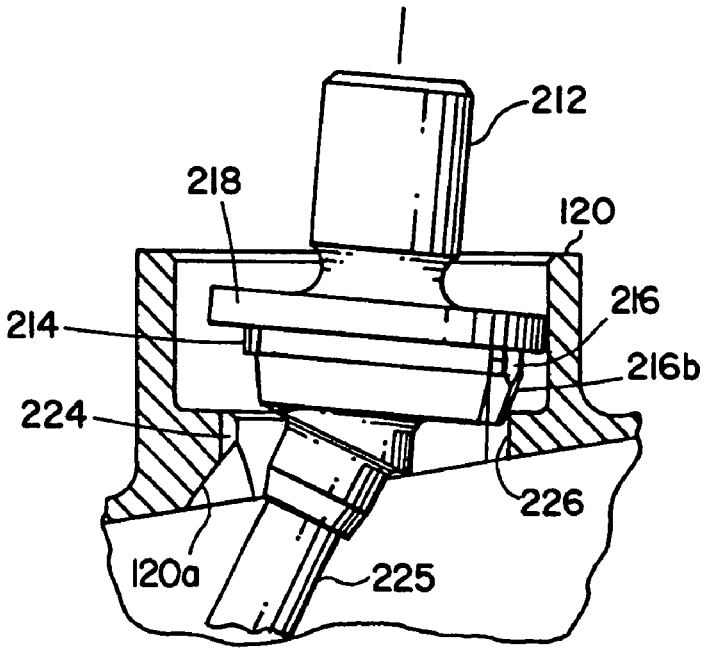
FIGS. 7*a* through 7*d* illustrate the guided installation of the fuel injector of FIG. 5 into the reception bore of the engine case, wherein the leading alignment structure provides a camming surface for mechanically guiding the inlet end portion of the fuel injector into a seated position within the reception bore of the engine case.

During installation, the geometric relationship between the angled feed arm 225 of fuel injector 200 and the interior walls of engine case 120 are such that it is necessary to initially introduce the inlet fitting 212 into the reception bore 122 of engine case 120 at an angle relative to the axis of the reception bore 122, as shown for example in FIG. 7*a*. The lower extremity 120*a* of reception bore 122 is machined in a manner that further accommodates the angled introduction of the feed arm 225 of fuel injector 200 into the engine case 120.

Figure 7B:
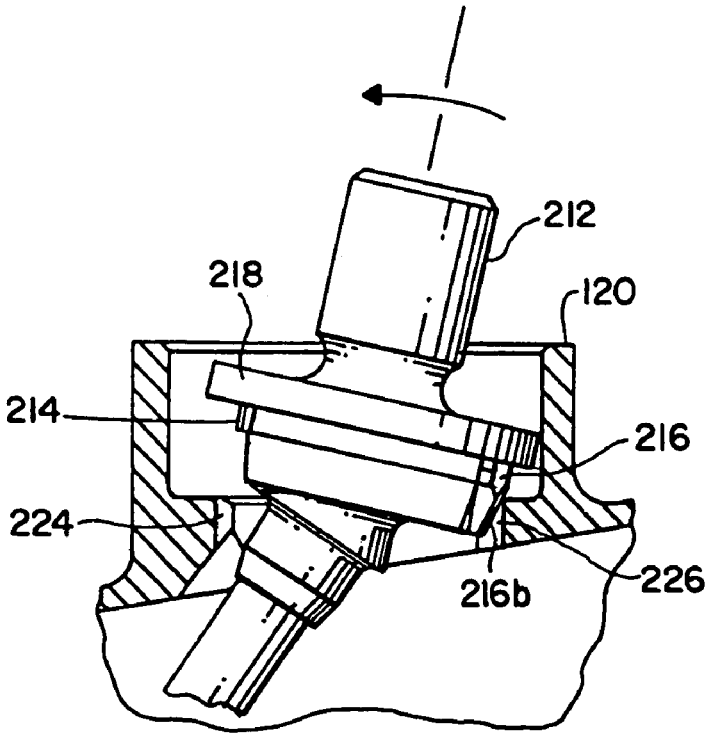
Figure 7C:
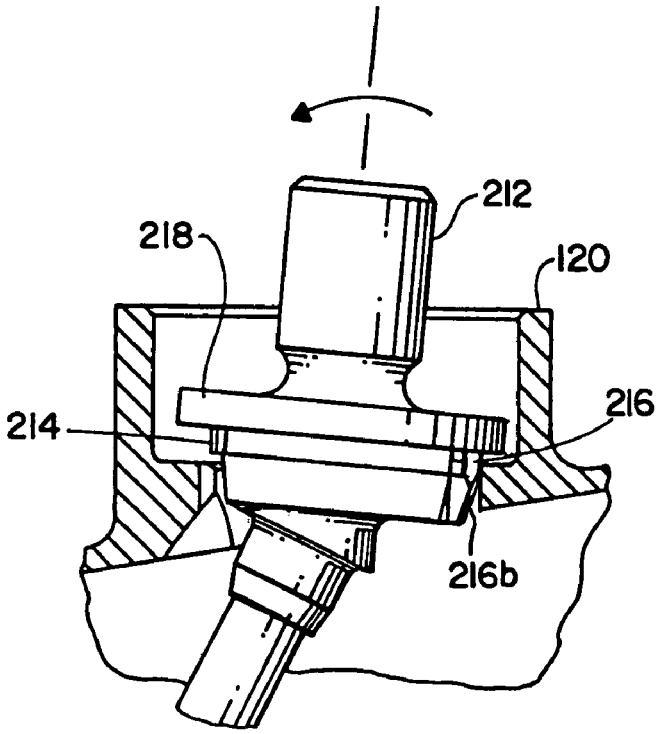

In accordance with the subject invention, the inwardly tapered facet 216*b* of the truncated convex outer surface 216*a* of leading alignment structure 216, which is best seen in FIG. 6, acts as a relatively long camming surface against the leading edge of reception notch 226, during the installation of fuel injector 200. This mechanical interaction facilitates rotational or pivotal movement of the fuel inlet fitting 212 of fuel injector 200 in a counter-clockwise direction, as shown in FIGS. 7*b* and 7*c*. This guided rotational or pivotal movement continues until the trailing alignment structure 214 engages the corresponding reception notch 224 in reception bore 122.

Figure 7D:
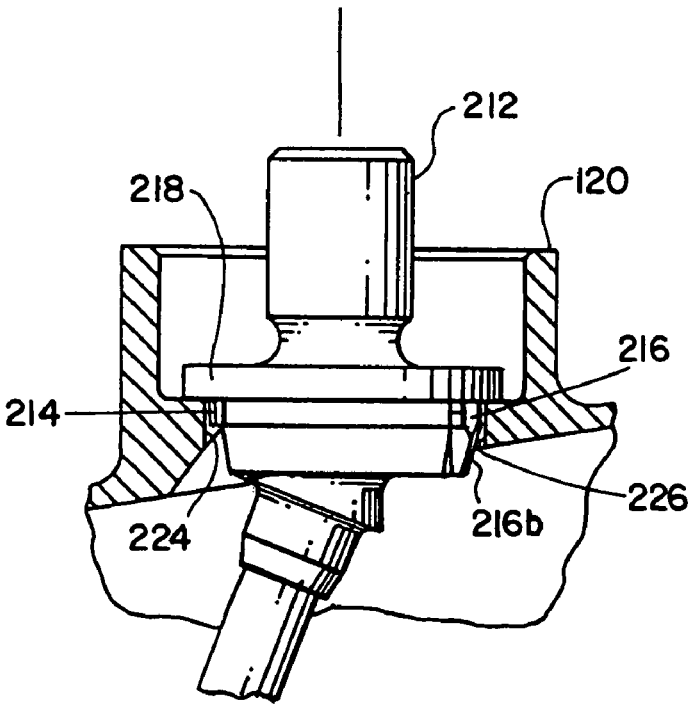

Continued counter-clockwise rotation of the inlet fitting 212 brings the lower end surface 218*a* of mounting flange 218 into a seated position within reception bore 120, as shown in FIG. 7*d*. At such a time, the central axis of inlet fitting 212 is axially aligned with the central axis of reception bore 120, and the alignment structures 214 and 216 prevent axial rotation of the fuel injector to ensure the feed arm 225 is properly oriented in the engine case. Thereafter, a threaded nut and accompanying seal (not shown) are installed in the engine case to secure the inlet fitting 212 within the reception bore 120.

It is envisioned and well within the scope of the subject disclosure that additional alignment and positioning features or means can be formed with or otherwise provided on the fuel inlet fitting of the subject invention. Such structural features may be located on or near the mounting flange of the fuel inlet fitting, and may be employed in conjunction with, supplemental to or in addition to the alignment and positioning structures described hereinabove.

Although the fuel injector alignment and positioning system of the subject invention has been described with respect to preferred embodiments, those skilled in the art will readily appreciate that changes and modifications may be made thereto without departing from the spirit and scope of the subject invention as defined by the appended claims.

What is claimed is:

1. A fuel injector for a gas turbine engine, the gas turbine engine having an engine case that includes a reception bore for accommodating the fuel injector, the fuel injector comprising: a fuel inlet fitting having an annular mounting flange defining opposed upper and lower end surfaces and a generally cylindrical body portion which depends axially from the lower end surface of the mounting flange, the fuel inlet fitting having a pair of alignment structures depending from the lower end surface of the mounting flange and extending radially outwardly from the body portion of the fuel inlet fitting, wherein one of the alignment structures has a camming facet that is adapted and configured to interact with an edge of the reception bore of the engine case, so as to facilitate pivotal movement of the fuel injector into an installed position within the reception bore of the engine case.

2. A fuel injector as recited in claim 1, wherein the alignment structures are formed integral with the fuel inlet fitting.

3. A fuel injector as recited in claim 1, wherein the alignment structures are diametrically opposed to one another relative to the axis of the generally cylindrical body portion.

4. A fuel injector as recited in claim 1, wherein the alignment structures are dissimilar in axial height relative to the generally cylindrical body portion.

5. A fuel injector as recited in claim 4, wherein the generally cylindrical body portion includes an upper cylindrical section and a lower inwardly tapered section.

6. A fuel injector as recited in claim 5, wherein the alignment structures include a leading alignment structure and a trailing alignment structure, and wherein the leading alignment structure has an axial height greater than the axial height of the trailing alignment structure relative to the axial height of the generally cylindrical body portion.

7. A fuel injector as recited in claim 6, wherein the leading alignment structure has an axial height substantially equal to the axial height of the generally cylindrical body portion, and the trailing alignment structure has an axial height substantially equal to the axial height of the upper cylindrical section of the generally cylindrical body portion.

8. A fuel injector as recited in claim 6, wherein the leading alignment structure has an axial height substantially equal to the axial height of the upper cylindrical section of the generally cylindrical body portion, and the trailing alignment structure has an axial height that is less than the axial height of the upper cylindrical section of the generally cylindrical body portion.

9. A fuel injector as recited in claim 6, wherein the trailing alignment structure has a generally rectangular configuration that includes a convex outer surface.

10. A fuel injector as recited in claim 6, wherein the leading alignment structure has a polygonal configuration that includes a truncated convex outer surface, and wherein the truncation defines the camming facet for interacting with the edge of the reception bore of the engine case.

11. A fuel injector as recited in claim 1, wherein the alignment structures are positioned and configured to align with corresponding reception notches defined within the reception bore of the engine case.

12. A fuel injector for a gas turbine engine, the gas turbine engine having an engine case that includes a reception bore for accommodating the fuel injector, the fuel injector comprising: a fuel inlet fitting having an annular mounting flange defining opposed upper and lower end surfaces and a generally cylindrical body portion which depends axially from the lower end surface of the mounting flange, the inlet fitting having a pair of integrally formed, diametrically opposed alignment structures located beneath the lower end surface of the mounting flange and extending radially outwardly from the body portion of the fuel inlet fitting, wherein one of the integrally formed alignment structures has a camming facet that is adapted and configured to interact with an edge of the reception bore of the engine case, so as to facilitate pivotal movement of the fuel injector into an installed position within the reception bore of the engine case, such that the alignment structures are accommodated with corresponding diametrically opposed reception notches defined within the reception bore.

13. A fuel injector as recited in claim 12, wherein the alignment structures are dissimilar in axial height relative to the generally cylindrical body portion.

14. A fuel injector as recited in claim 13, wherein the generally cylindrical body portion includes an upper cylindrical section and a lower inwardly tapered section.

15. A fuel injector as recited in claim 14, wherein the alignment structures include a leading alignment structure and a trailing alignment structure, and wherein the leading alignment structure has an axial height greater than the axial height of the trailing alignment structure relative to the axial height of the generally cylindrical body portion.

16. A fuel injector as recited in claim 15, wherein the leading alignment structure has an axial height substantially equal to the axial height of the generally cylindrical body portion, and the trailing alignment structure has an axial height substantially equal to the axial height of the upper cylindrical section of the generally cylindrical body portion.

17. A fuel injector as recited in claim 15, wherein the leading alignment structure has an axial height substantially equal to the axial height of the upper cylindrical section of the generally cylindrical body portion, and the trailing alignment structure has an axial height that is less than the axial height of the upper cylindrical section of the generally cylindrical body portion.

18. A fuel injector as recited in claim 15, wherein the trailing alignment structure has a generally rectangular configuration that includes a convex outer surface.

19. A fuel injector as recited in claim 15, wherein the leading alignment structure has a polygonal configuration that includes a truncated convex outer surface, and wherein the truncation defines the camming facet for interacting with the edge of the reception bore of the engine case.

20. A fuel injector for a gas turbine engine, the gas turbine engine having an engine case that includes a reception bore for accommodating the fuel injector, the fuel injector comprising: a fuel inlet fitting having an annular mounting flange defining opposed upper and lower end surfaces and a cylindrical body portion which depends axially from the lower end surface of the mounting flange, the inlet fitting having integrally formed alignment means located beneath the lower end surface of the mounting flange, the alignment means having camming means for interacting with an edge of the reception bore of the engine case for rotationally guiding the fuel injector into an installed position within the reception bore of the engine case.

21. A fuel injector comprising: a fuel inlet fitting having an annular mounting flange defining opposed upper and lower end surfaces and a generally cylindrical body portion which depends axially from the lower end surface of the annular mounting flange, the fuel inlet fitting having a pair of alignment structures formed integral with the fuel inlet fitting, depending from the lower end surface of the annular mounting flange and extending radially outwardly from the body portion of the fuel inlet fitting, wherein the alignment structures are diametrically opposed to one another relative to the axis of the generally cylindrical body portion and are dissimilar in axial height relative to the generally cylindrical body portion, and wherein one of the alignment structures has a camming facet for interacting with an edge of the reception bore of the engine case, so as to facilitate pivotal movement of the fuel injector into an installed position within the reception bore of the engine case.

22. A fuel injector for a gas turbine engine, the gas turbine engine having an engine case that includes a reception bore for accommodating the fuel injector, the fuel injector comprising: a fuel inlet fitting having an annular mounting flange defining opposed upper and lower end surfaces and a generally cylindrical body portion which depends axially from the lower end surface of the mounting flange, the fuel inlet fitting having a pair of alignment structures depending from the lower end surface of the mounting flange and extending radially outwardly from the body portion of the fuel inlet fitting, wherein the alignment structures are adapted and configured to guide the fuel injector into an installed position within the reception bore of the engine case, wherein the alignment structures are dissimilar in axial height relative to the generally cylindrical body portion, wherein the generally cylindrical body portion includes an upper cylindrical section and a lower inwardly tapered section, wherein the alignment structures include a leading alignment structure and a trailing alignment structure, and wherein the leading alignment structure has an axial height greater than the axial height of the trailing alignment structure relative to the axial height of the generally cylindrical body portion, and wherein the leading alignment structure has a polygonal configuration that includes a truncated convex outer surface, and wherein the truncation defines a camming facet for interacting with the reception bore of the engine case.

* * * * *